United States Patent [19]

Smith et al.

[11] Patent Number: 4,856,395

[45] Date of Patent: Aug. 15, 1989

[54] CUTTING MECHANISMS

[75] Inventors: Frank A. F. Smith, Godstone; Trevor A. Ludlow, East Grinstead, both of England

[73] Assignee: Redland Roof Tiles Limited, England

[21] Appl. No.: 123,047

[22] Filed: Nov. 19, 1987

[30] Foreign Application Priority Data

Nov. 28, 1986 [GB] United Kingdom ..... 8628465

[51] Int. Cl.[4] ..... B26D 7/06; B26D 1/56; B28B 11/12; B28B 11/14

[52] U.S. Cl. ..... 83/158; 83/161; 83/293; 83/308; 425/308; 425/313; 425/315; 425/DIG. 5; 425/DIG. 202; 264/145; 264/157; 264/163

[58] Field of Search ..... 425/289, 295–297, 425/301–308, DIG. 5, 436 RM, 311–313, 220, 254, 315–318; 264/148, 151, 153, 157–158, 161–163; 83/284–285, 298, 318, 308, 406–408, 887, 41–50, 158–161, 293; 156/267, 256, 570, 511

[56] References Cited

U.S. PATENT DOCUMENTS

| | | | |
|---|---|---|---|
| 666,963 | 1/1901 | Jacquart et al. | 264/161 |
| 2,683,297 | 7/1954 | Lea | 425/301 |
| 3,035,469 | 5/1962 | Schmunk et al. | 425/316 |
| 3,263,011 | 7/1966 | Jagger et al. | 264/163 |
| 3,360,420 | 12/1967 | Paul et al. | 264/163 |
| 3,782,329 | 1/1974 | Everett | 425/311 |
| 4,668,151 | 5/1987 | Oberoi et al. | 414/277 |
| 4,695,418 | 9/1987 | Baker et al. | 425/220 |

FOREIGN PATENT DOCUMENTS

| | | | |
|---|---|---|---|
| 2757190 | 6/1979 | Fed. Rep. of Germany | 264/151 |
| 2810713 | 9/1979 | Fed. Rep. of Germany | 83/284 |
| 2375970 | 7/1978 | France | 425/316 |
| 55-5879 | 1/1980 | Japan | 264/148 |
| 2028710 | 3/1980 | United Kingdom . | |

*Primary Examiner*—Richard L. Chiesa
*Assistant Examiner*—Mathieu Vargot
*Attorney, Agent, or Firm*—Scherlacher, Mok & Roth

[57] ABSTRACT

This invention relates to a cutting mechanism and its method of operation in "cutting side-lock" portions from "green state" roofing tiles. The tiles are manufactured in a conventional concrete roofing tile making plant in which mortar fed to a hopper extruder (18) of conventional design is formed as a continuous ribbon (26) on a series of pallets (P) conveyed beneath the hopper extruder (18). The ribbon (26) is thereafter cut by a knife (3) into discrete tiles (T) on said pallets (P) with a "side-lock" portion of each tile being blanked out by extension portions (32) (34) of the knife (30). The blanked out portions are thereafter removed from the remainder of the tiles by a blade 90 of removal means 14 such that no damage is caused to the tiles (T) and little or not detritus remains on the tile or the conveyors of the tile making plant.

19 Claims, 5 Drawing Sheets

16
14
18
20
22
24
26
28
30
32
34
12
40
41
45
46
47
49
P
T 12
14
30
32
34
122
I

CUTTING MECHANISMS

This invention is concerned with improvements in cutting mechanisms and their method of operation and is particularly, although not exclusively concerned with improvements in cutting mechanisms for removing portions of "green state" roofing tiles and the method of operating the mechanism to remove said portions.

In the manufacture of concrete roofing tiles, mortar fed to a hopper extruder of conventional design is formed as a continuous ribbon of extrudate on a series of tile pallets conveyed beneath the hopper. Thereafter the ribbon of mortar on the said pallets is subjected to the cutting action of a knife or knives of conventional design whereby the ribbon of extrudate is cut into discrete tiles on said pallets.

If other portions of the tiles are to be cut to provide cut-a-way portions, it is usual to provide extra knives, or the like, for severing the appropriate portion or portions. With tiles which are to be provided with side-lock portions which are cut-away at "toe" and/or "head" ends of the tiles, i.e. at the lower or upper ends thereof in use, one way of achieving such a feature in the "green-state" tiles is to provide an extension portion, to the knife or knives used to cut the tiles into discrete lengths.

Difficulty has arisen in ensuring that the blanked-out portion of a "green-state" tile is removed effectively from the remainder of the tile such that the tile is undamaged and little or no detritus remains on the tile or the conveyor by which a pallet carrying the tile is conveyed through the tile plant.

This problem is particularly evident in connection with extruded concrete tiles where the nature of the material from which the tiles are being made may vary considerably from plant to plant depending upon the grades of sands, etc. which are available for the manufacture of concrete roofing tiles.

The present invention seeks to mitigate the disadvantages met hitherto and thus conveniently provides a cutting mechanism, which may be adapted for use in the removal of a portion of a roofing tile, the mechanism comprising blanking means operable when the cutting mechanism is in use to blank out said portion from the remainder of a roofing tile and removal means also operable when the cutting mechanism is in use to cause removal of said blanked out portion of the roofing tile.

There now follows by way of example a detailed description of one embodiment of the invention, which description is to be read with reference to the accompanying drawings.

DETAILED DESCRIPTION

In tiles which are provided with a cut-away portion at the toe end of a "side-lock" or like portion, some difficulty has been met in ensuring that the portion of "green-state" tiles are removed cleanly from the rest of the tile and that no detritus remains to foul the conveyor line or to cause detrimental damage to the tiles, etc.

The present invention, thus, comprises a unique combination of blanking tool 12 and removal means 14 located in a tile making plant 16 downstream of the blanking tool 12 whereby portions of successive green-state tiles T, blanked out by said tool 12, are removed from the tiles in such a manner that no superfluous detritus remains on the tile or plant.

Figure 1:
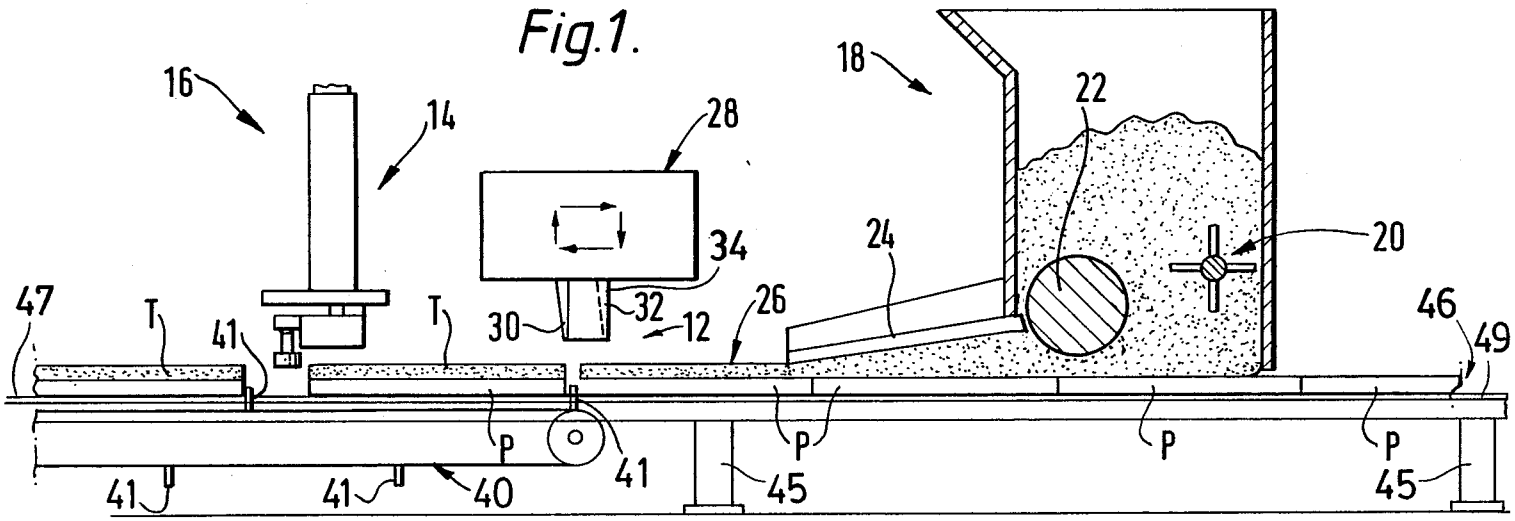
FIG. 1 is a diagrammatic part side view of a tile making plant showing a mortar hopper, tile cutting knife/-blanking tool and a blanked-out tile portion removal means.

The tile plant 16, see FIG. 1, comprises a mortar hopper 18 of conventional design and having a pack-shaft 20, a roller 22 and slipper 24.

Tile pallets P are fed seriatim through the hopper 18 whereby mortar in the hopper is extruded to form a continuous ribbon 26 of mortar on the pallets P.

Figure 6:
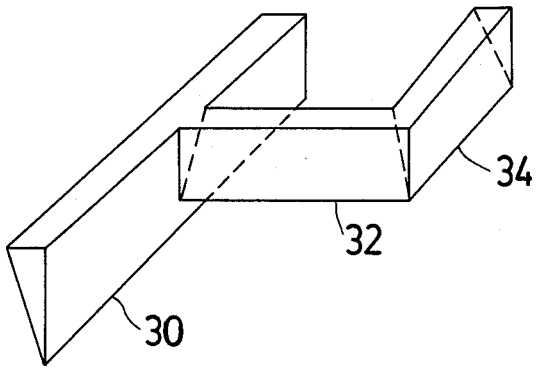
FIG. 6 is a detailed perspective view of the tile cutting knife/blanking tool of FIG. 1.

Downstream of the hopper 18, the plant 16 comprises a knife mechanism 28 which comprises support for a conventional tile cutting knife 30 and the blanking tool 12. The blanking tool 12 extends rearwardly of the knife 30, i.e. upstream thereof, and comprises a first portion 32 extending normally, or substantially so, to the knife 30 and a second portion 34 extending normally to said first portion 32 but parallel or substantially parallel to the knife 30 (see FIG. 2). For purposes of additional illustration of the knife mechanism 28 FIG. 6 shows a perspective view solely of the tile cutting knife 30, and the blanking tool 12 which comprises a first portion 32 and a second portion 34. As will be further explained in detail later, the portions 32 and 34 serve only to delineate the blanked out portion 122, and consequently the penetration of the portions 32 and 34 into the continuous mortar ribbon 26 is not as deep as the complete cut provided by knife 30. Accordingly the portions 32 and 34 are sized to provide about two-thirds of the cutting depth as does the knife 30.

Downstream of the knife mechanism 28, the plant 16 is provided with pallet registering means 40 of conventional design (see FIG. 1), whereby when the plant is in use and discrete tiles have been formed on the pallets P, drive dogs 41 of the means 40 engage with undersides or trailing edges of the pallets P, as shown in FIG. 1, to accelerate the pallets away from the knife mechanism 28 and to create a "gapped" relationship between successive pallets.

The removal means 14 (see FIGS. 3 and 4) is located on a frame member 42 fixedly secured by any one of a number of conventional techniques to a side frame portion 44 of a conveyor assembly 46 of the tile making plant 16. The side frame portion 44 is carried by floor mounted columns 45 of the conveyor assembly 46. The pallets P are conveyed along on metal strips 47 that are mounted by any one of a number of conventional securing means to upwardly facing surfaces 49 of the side frame portion 44.

The member 42 extends upwardly from said portion 44 (see especially FIG. 4) and provides support for an arm 48 which extends inwardly and in an upstream direction, with reference to the conveyor assembly 46, to overlie the pallets P and tiles T conveyed along the conveyor assembly 46 when the plant 16 is in use.

Figure 3:
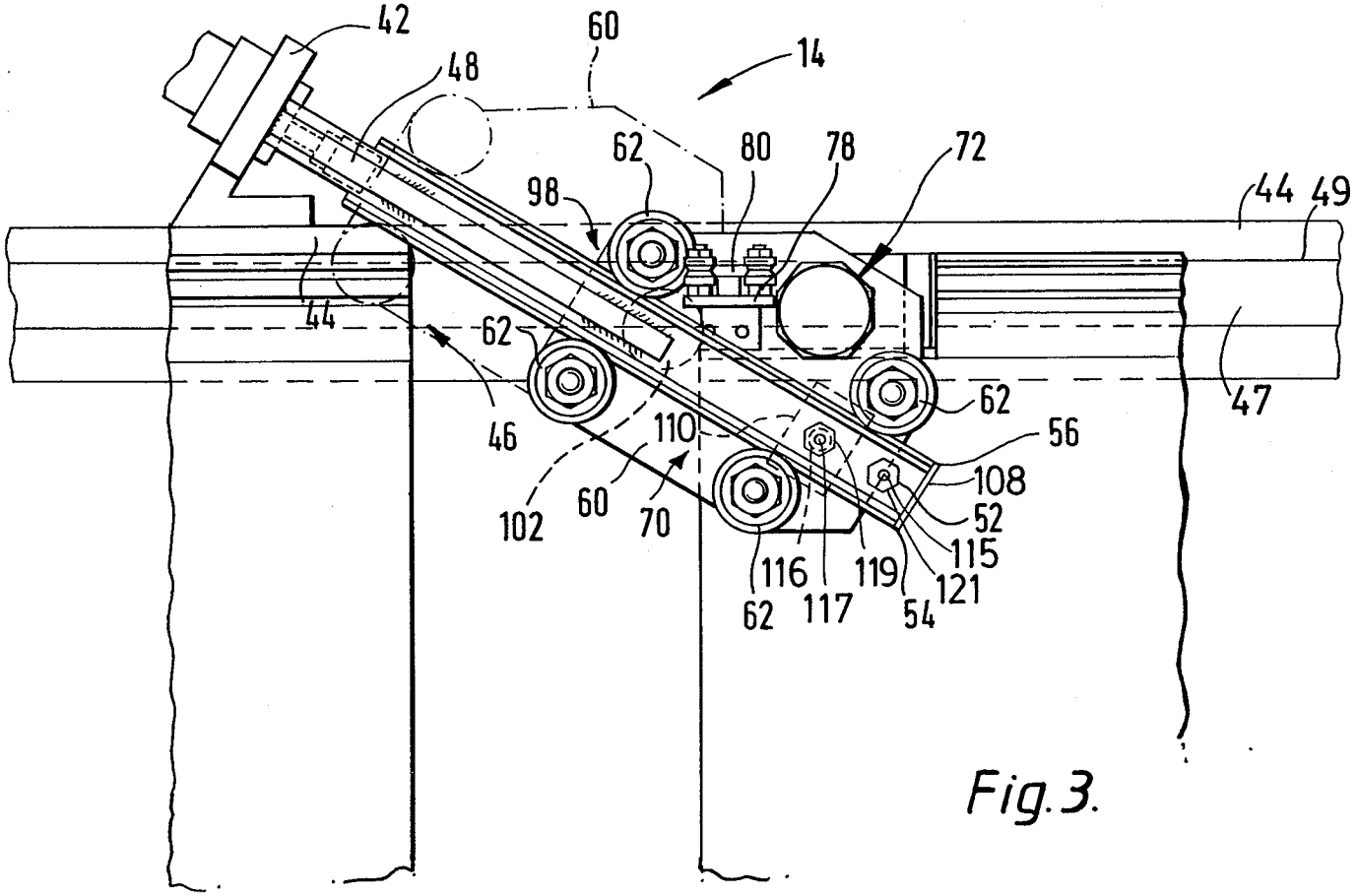
FIG. 3 is a detail view on a larger scale of parts shown in FIG. 2.
Figure 4:
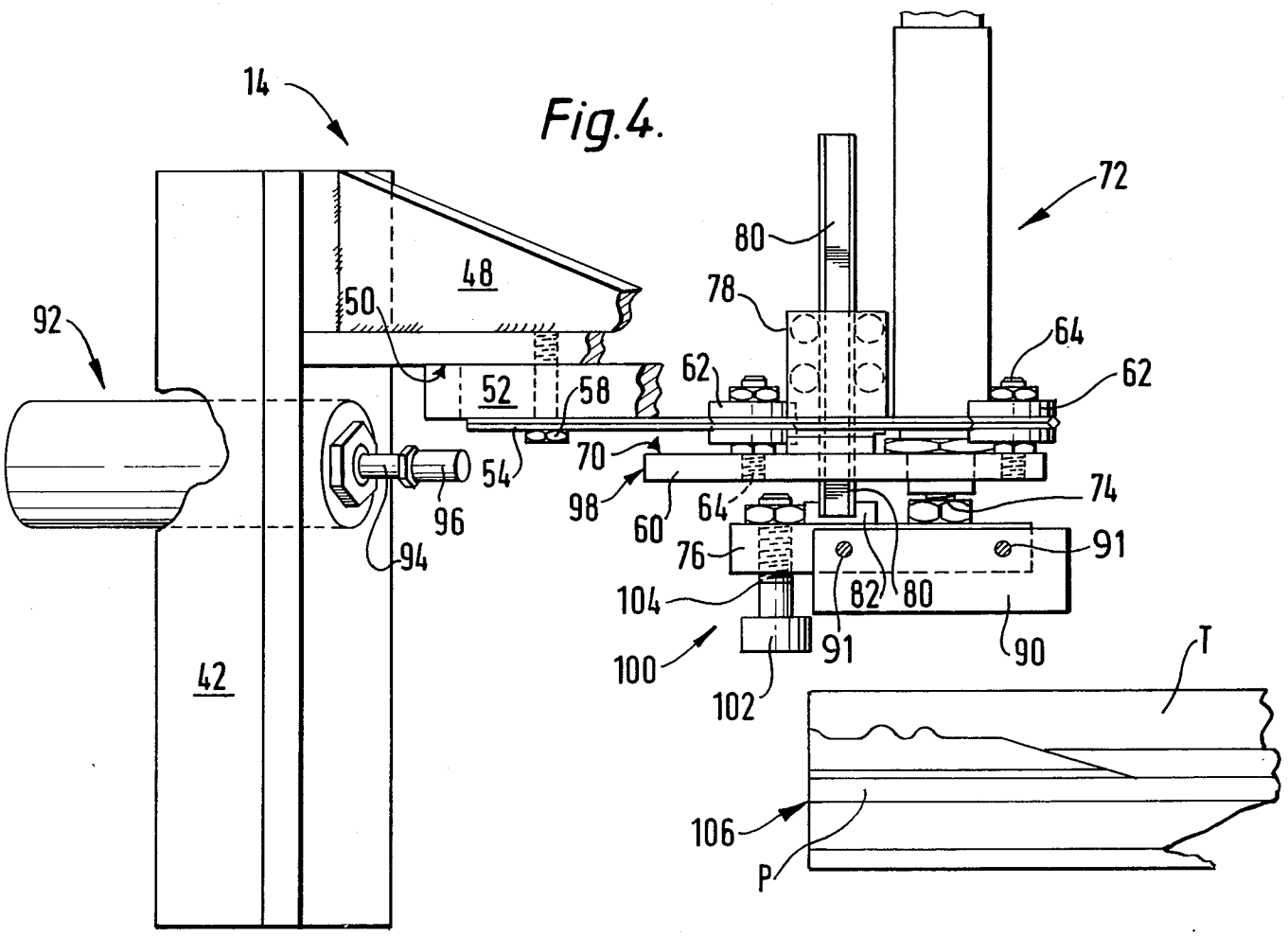
FIG. 4 is a detail view on a larger scale of parts shown in FIG. 1; and, FIG. 5 is a side elevation of stop means not shown in FIGS. 3 and 4.

The arm 48 is of inverted "T" shape in cross-section and provides support on an underside 50 thereof for a bar 52 and guides 54 and 56 (see FIGS. 3 and 4). The bar 52 and guides 54 and 56 are fixedly secured to the arm 48 by two short bolts 58, only one of which is shown in FIG. 4.

Figure 5:
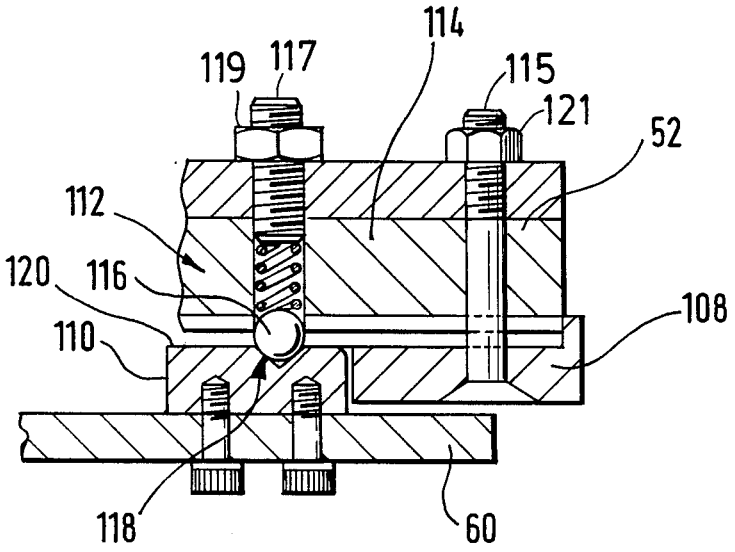

The removal means 14 further comprises a carriage 60 (see particularly FIGS. 3, 4 and 5) slidably mounted for movement along and below said bar 52 between an operative position shown in FIGS. 3 and 4 and an inoperative position remote therefrom as shown in chain dotted lines in FIG. 3.

The carriage 60 is provided with four tracking rolls 62 of conventional design, which rolls 62 are rotatably mounted on bearing studs 64 secured in said carriage 60 while the rolls 62 engage with the guides 54 and 56 of the bar 52 to facilitate the movement of the carriage 60 along the bar 52 as aforesaid.

The carriage 60 provides support on an upper surface 70 for a piston and cylinder arrangement 72, the piston rod 74 of which extends through the carriage 60 to be fixedly secured to a carrier plate 76 (see FIG. 4). Also mounted on the upper surface 70 of the carriage 60 is a slide block 78 for a slide bar 80, which block 78 and bar 80 are arranged adjacent and parallel with an axis of the piston and cylinder arrangement 72. The slide bar 80, like the piston rod 74, also extends through the carriage 60 and is fixedly secured to the carrier plate 76 by means of a mounting bracket 82 (see FIG. 4).

Thus, the carrier plate 76 is mounted on the carriage 60 for movement towards and away therefrom via the agency of the piston and cylinder arrangement 72 and the slide bar 80.

The carrier plate 76 provides support for a knife blade 90 secured thereto by screws 91 as shown in FIG. 4; thus, when the removal means is in use with the carriage 60 moving towards its operative position, movement of the carrier plate 76 away from the carriage 60 moves the blade 90 towards an operative condition in which it is in position to engage with a blanked-out portion of a roofing tile moving therepast. Movement of the plate 76 towards said carriage moves the blade 90 away from its operative condition.

The removal means 14 also comprises piston and cylinder means 92 for causing movement of said carriage 60 between its inoperative and operative positions, said means 92 being supported on the frame member 42. The means 92 comprises a piston rod 94 which extends through the member 42 as shown in FIG. 4 and is provided on an outward end thereof with a plastics pusher element 96.

In use the element 96 engages with a trailing end 98 of the carriage 60 to move the carriage 60 to its operative position; however, the return stroke of the piston and cylinder means 92 is by conventional spring return ahead of movement of the carriage 60 towards its inoperative position.

The removal means 14 further comprises a camming means 100 provided by a cam roll 102 rotatably mounted on a stud 104 fixedly mounted on and depending from the carrier plate 76.

With the carriage 60 and the carrier plate 76 in their respective operative positions, cam roll 102 is engaged by a leading edge 106 of a tile pallet P to cause movement of the carriage 60 from its operative towards its inoperative position. The operation of the removal means will be more fully described hereinafter.

For locating the carriage 60 in its operative position as shown in FIG. 4, the removal means 14 further comprises a stop member 108 (see FIG. 5) against which an abutment plate 110, carried on the upper surface 70 of the carriage 60, abuts when the carriage is in said operative position.

For maintaining the carriage in said position, the removal means 14 also comprises a spring loaded poppet arrangement 112 located in an outer end portion 114 of the bar 52 (see FIGS. 3 and 5), a poppet 116 of which engages with and is accommodated in a "vee" shaped groove 118 provided in a upper surface 120 of the abutment plate 110.

When the specific embodiment herein described is in use and a ribbon 26 of mortar is extruded onto a series of pallets P as aforesaid, the ribbon 26 is subjected to the cutting action of the knife 30 to sever the ribbon to form a discrete tile T on each pallet P.

Figure 2:
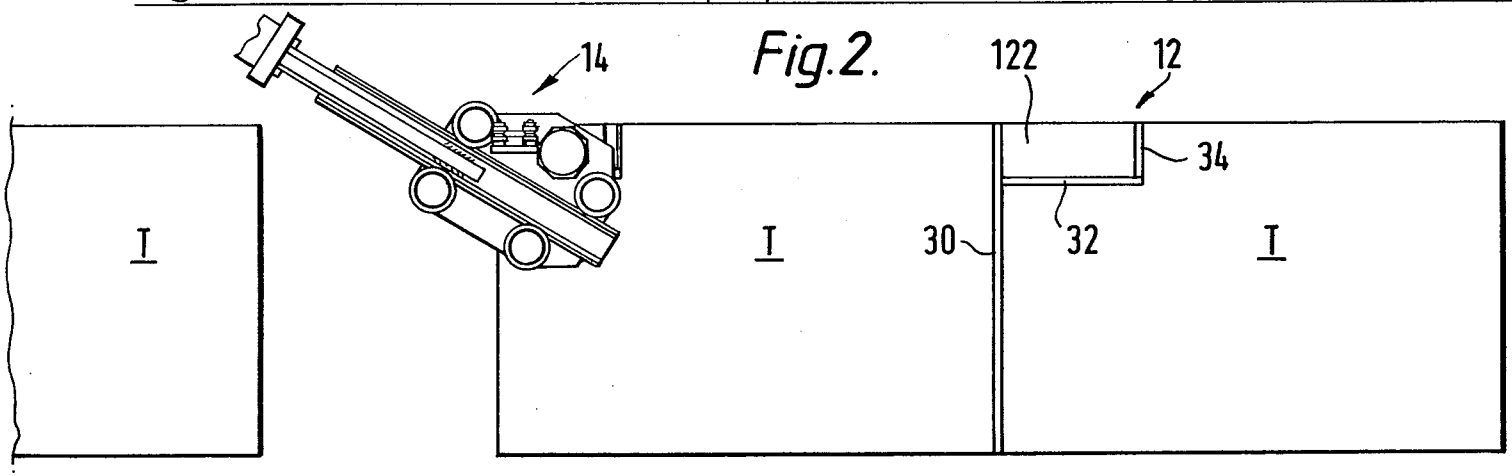
FIG. 2 is a diagrammatic plan view of part of the plant shown in FIG. 1.

Concomitantly with the formation of the discrete tiles as aforesaid, the blanking tool 12 delineates a portion 122 of a leading side-lock portion for removal from the tile T (see FIG. 2).

The pallets P, with the discrete tiles T formed thereon with the blanked out portions 122, are accelerated by engagement therewith of the drive dogs 41 of the pallet registering means 40. As shown in FIG. 1 directly after the formation of the discrete tiles T a drive dog 41 engages the trailing end of pallet P of the just formed tile T and advances it downstream towards the removal means 14. As the leading end of such pallet P engages the cam roll 102 movement of the blade 90 commences. By this means a defined gap is created between successive pallets P for a purpose to be made clear hereinafter. The "gapped" pallets P are conveyed downstream by the registering means to the removal means whereat:

(i) the piston and cylinder means 92 is operated to cause movement of the carriage 60 from its inoperative to its operative position;

(ii) the piston and cylinder arrangement 72 is operated concomitantly with or shortly after the operation of the means 92 to cause the carrier plate 76, and thus the blade 90, to be moved to an operative condition, in which the blade 90 is positioned immediately downstream of a next in line pallet P, the blade also being in line with the portion of severed tile delineated by the portion 32 of the blanking tool 12;

(iii) the registering means continues to feed the pallets P as aforesaid as the means 92 moves the carriage towards its operative position whereat:

(a) the blade 90 moves into an operative position in which it engages with the blanked out portion of the tile T; and (b) the roll 102 of the camming means is engaged by the leading edge 106 of the pallet P;

(iv) the pallet P pushes the roll 102 to cause longitudinal and sideways movement of the blade 90 as the carriage 60 is moved between its operative and inoperative positions and, in moving as aforesaid, the blade 90 is moved out of its operative position and cleanly removes the portion of the tile T delineated by the blanking tool 12;

(v) the cylinder arrangement 72 is then operated in a reverse mode to that of step (ii) above to return the carrier plate 76 and thus the blade 90 to an inoperative condition.

Tiles T produced in such a way have a cut-a-way lower "side-lock" portion whereby in use on a roof the "side-lock" portion is not visible when looking at the front edges of tiles laid on a roof.

In one alternative embodiment the removal means may be constituted by a mechanism associated with the blanking tool 12 which in use could be pivoted widthwise of a "green-state" tile moving therepast to remove the portion 122 delineated by the tool 12.

In a further embodiment the blanking out and removal of the portions 122 from "green-state" tiles T may be carried out by the removal means of the present invention modified so that the carriage is operated by a fast acting two way piston and cylinder arrangement instead of relying on the roll 102 being engaged by the leading edges of the tile pallets for the return of the carriage 60.

In such a case the carrier plate 76 and blade 90 would initially be maintained at a level above the approaching tile T on a pallet P and upon firing of the equivalent of the piston and cylinder arrangement 72, the blade, which would also be of "L" shaped configuration, would delineate the portion to be removed thereafter by longitudinal and sideways travel of the carrier plate and blade as the carriage is returned towards its inoperative position by the piston and cylinder arrangement which is capable of causing movement of said components ahead of the following tile from which the cut-a-way portion is being removed.

Other modification may be made within the scope of the present invention.

What is claimed is:

1. A cutting mechanism adapted for use in the removal of a portion of a roofing tile while in a green state comprising:

(a) blanking means to blank out said portion from the remainder of a roofing tile while in the green state; and (b) removal means for removing said blanked out portion of the roofing tile.

2. A mechanism according to claim 1, wherein a continuous ribbon of roofing tile is carried on tile pallet means towards the blanking means and wherein the blanking means further comprises tile cutting knife means, the blanking means and the tile cutting knife means being mutually operable for concomitantly separating one tile from the ribbon and blanking out said portion on such separated tile.

3. A mechanism according to claim 1, wherein the removal means is located downstream of said blanking means.

4. A mechanism according to claim 1, wherein the roofing tile is carried on a tile pallet along a conveyor track past the removal means and wherein the removal means comprises cam means for contacting the tile pallet, cutting blade means and means for moving the cutting blade means in a direction:

a) substantially normally with respect to said tile pallet from an inoperative position to an operative position in which the cutting blade means is in registration and contact with said blanked out portion of said roofing tile; and thereafter, (b) obliquely with respect to the conveyor track during contact of the tile pallet with the cam means, whereby during such contact, said blanked-out portion is removed from such roofing tile.

5. A mechanism according to claim 4, wherein said cutting blade means is carried on a carriage for movement downstream of said blanking means.

6. A mechanism according to claim 5, wherein said carriage is slideably mounted on a bar mounted alongside the conveyor track for carrying the cutting blade means towards and away from a tile pallet passing thereby.

7. A mechanism according to claim 5, further comprising blade operating means supported by the carriage for moving the cutting blade means towards and away from said carriage between its operative and inoperative positions.

8. A mechanism according to claim 5, further comprising carriage moving means adapted to move the carriage towards a tile pallet passing thereby.

9. A mechanism according to claim 5, further comprising cam means adapted to engage a leading end portion of a tile pallet, the cam means when in contact with said tile pallet thereby causing the carriage to be moved transversely and longitudinally with respect to the conveyor track when the cutting blade means is in said operative position whereby said blanked out portion is removed from the respective tile.

10. A mechanism according to claim 9, wherein the cam means comprises a roller rotatably mounted to said carriage.

11. A mechanism according to claim 5, further comprising piston and cylinder means for moving the carriage towards a tile pallet passing thereby.

12. A mechanism according to claim 5, wherein said carriage is slideably mounted on a bar which is fixedly mounted alongside the conveyor track, the conveyor track, the carriage adapted for carrying the cutting blade means towards and away from a tile pallet passing thereby, said carriage adapted to support a blade operating means adapted for moving the cutting blade means towards and away from said carriage between its operative and inoperative conditions, and the mechanism further comprising carriage moving means adapted to move the carriage towards a tile pallet passing thereby, the cam means adapted to engage a leading end portion of a tile pallet, the cam means when in contact with said tile pallet thereby causing the carriage to be moved transversely and longitudinally with respect to the conveyor track when the cutting blade means is in said operative position whereby said blanked out portion is removed from the respective tile.

13. A mechanism in accordance with claim 12, wherein the cam means comprises a roller rotatably mounted to said carriage, and the carriage moving means comprises piston and cylinder means.

14. A mechanism according to claim 4 wherein the oblique movement of the cutting blade means comprises movement components both along and in the transverse direction with respect to the conveyor track.

15. A mechanism according to claim 14 wherein the movement component of the cutting blade means along the conveyor track is at the same speed as the tile pallet such that the relative motion of the cutting blade means with respect to such tile pallet is solely in the transverse direction.

16. A tile cutting apparatus for removing a portion of a tile while in the green state comprising:

means for conveying the tile along a path;

means for blanking out a portion of the tile at a first location with respect to the path;

means for removing portion of the tile at a second location downstream from the first location comprising cutting blade means movable obliquely with respect to the path, the cutting blade means responsive to the movement of a respective tile such that the cutting blade means contacts the respective tile at the second location for removal of the portion such that the relative motion of the cutting blade means with respect to such tile, during removal of the portion, is in a direction transverse to the path.

17. A tile cutting apparatus according to claim 16 wherein the means for blanking further comprises means for cutting the tile into discrete tiles.

18. A tile cutting apparatus according to claim 16 wherein the blanking means comprises three cutting blades, a first blade adapted to penetrate the tile completely to cut the tile into discrete tiles, and second and third blades oriented with respect to each other to conform to the shape of the preselected portion, the second and third blades adapted to substantially but not completely penetrate through the tile.

19. A tile cutting apparatus according to claim 16 wherein the blanking means comprises three cutting blades, a first blade adapted to cut the tile into discrete tiles, a second blade substantially parallel to the first blade and a third blade substantially orthogonal to the first blade and disposed between the first and second blades and in contact therewith, the second and third blades adapted to substantially but not completely penetrate through the tile.

* * * * *

UNITED STATES PATENT AND TRADEMARK OFFICE

CERTIFICATE OF CORRECTION

PATENT NO. : 4,856,395

DATED : August 15, 1989

INVENTOR(S) : Frank A. F. Smith et al.

It is certified that error appears in the above-identified patent and that said Letters Patent is hereby corrected as shown below:

Column 6, lines 27-28, delete second occurrence of "the conveyor track,".

Signed and Sealed this

Fourteenth Day of August, 1990

*Attest:*

HARRY F. MANBECK, JR.

*Attesting Officer*

*Commissioner of Patents and Trademarks*